US006685038B1

(12) United States Patent
Johnston et al.

(10) Patent No.: US 6,685,038 B1
(45) Date of Patent: Feb. 3, 2004

(54) EXTENDIBLE BOOM WITH LOCKING MECHANISM HAVING EQUALIZER ARRANGEMENT

(75) Inventors: Kevin L. Johnston, New Berlin, WI (US); Roger L. Johnston, Muskego, WI (US)

(73) Assignee: J & R Engineering Company, Inc., Mukwonago, WI (US)

( * ) Notice: Subject to any disclaimer, the term of this patent is extended or adjusted under 35 U.S.C. 154(b) by 0 days.

(21) Appl. No.: 09/419,835

(22) Filed: Oct. 15, 1999

(51) Int. Cl.[7] ..... B66C 23/00; B66C 17/00; B66C 19/00

(52) U.S. Cl. ..... 212/203; 212/312; 212/314

(58) Field of Search ..... 212/199, 203, 212/292, 171, 296, 312, 324, 230–232, 264, 348, 349, 314; 187/208, 203, 351, 369; 414/560, 561, 618; 294/114, 110.1, 81.61

(56) References Cited

U.S. PATENT DOCUMENTS

| | | | | |
|---|---|---|---|---|
| 1,031,470 A | * | 7/1912 | Sanna | 187/203 |
| 3,090,494 A | | 5/1963 | Thiele | 212/13 |
| 3,237,722 A | * | 3/1966 | Citrën | 187/208 |

(List continued on next page.)

FOREIGN PATENT DOCUMENTS

| | | |
|---|---|---|
| DE | 2 254 290 | 5/1973 |
| DE | 2 247 491 | 4/1974 |
| DE | 24 39 667 | 3/1976 |
| DE | 27 52 415 | 5/1979 |
| FR | 2 476 727 | 8/1981 |
| GB | 1 404 136 | 8/1975 |
| JP | 54-49748 | 4/1979 |
| RU | 688419 | 10/1979 |
| RU | 992 397 A | 2/1983 |

OTHER PUBLICATIONS

Power Tower & Wedgelock Systems Brochure, Lift Systems, Inc.

Lift–N–Lock, Brochure, J&R Engineering Co., Inc.

300T Boom–Lock Pinlock Power Tower, Lift Systems 1 page ad.

Several sheets containing both figures and text and labeled Section 5 Attaching the Load, pp. 26–32.

*Primary Examiner*—Eileen D. Lillis
*Assistant Examiner*—Raymond B. Johnson
(74) *Attorney, Agent, or Firm*—Boyle Fredrickson Newholm Stein & Gratz S.C.

(57) ABSTRACT

A extendible boom incorporates a locking mechanism that mechanically engages an extended boom section in response to the loss of hydraulic fluid pressure to the lift cylinder for that boom section so as to prevent unintended boom lowering. The locking mechanism includes locking devices, such as toothed cams, that are located on opposite sides of the boom and that are configured to move, 1) from a disengaged position permitting unobstructed movement of the extended section relative to the adjacent section, 2) to an engaged position in which the locking devices engage opposite sides of the extended section to prevent unintended boom lowering. In order to prevent the imposition of unequal locking forces that could occur if only the locking device on one side of the extended boom section were to engage that section, an equalizer arrangement mechanically couples the locking devices on opposite sides of the extended boom section to one another so that both locking devices always move through essentially the same stroke at essentially the same time. The equalizer arrangement preferably comprises an equalizer bar that mechanically couples pivot shafts of the two locking devices together so that rotation of one pivot shaft drives the other pivot shaft to simultaneously rotate through a pivot stroke that at least substantially equals a pivot stroke of the one shaft.

9 Claims, 4 Drawing Sheets

U.S. PATENT DOCUMENTS

| | | | | | |
|---|---|---|---|---|---|
| 3,335,875 | A | | 8/1967 | Fachinetti | 212/13 |
| 3,398,492 | A | | 8/1968 | Nansel | 52/115 |
| 3,462,023 | A | | 8/1969 | Grove | 212/55 |
| 3,795,321 | A | | 3/1974 | Johnston | 212/55 |
| 3,841,494 | A | | 10/1974 | Chalupsky et al. | 212/55 |
| 4,036,372 | A | | 7/1977 | Rao et al. | 212/144 |
| 4,260,064 | A | | 4/1981 | Ekstam | 212/231 |
| 4,350,255 | A | | 9/1982 | Blasé et al. | 212/268 |
| 4,381,839 | A | | 5/1983 | Engler et al. | 212/208 |
| 4,531,614 | A | * | 7/1985 | Naegeli | 187/208 |
| 4,573,853 | A | | 3/1986 | Lorenz | 414/460 |
| 5,012,898 | A | * | 5/1991 | Tsymberov | 187/208 |
| 5,865,327 | A | | 2/1999 | Johnston | 212/343 |

* cited by examiner

EXTENDIBLE BOOM WITH LOCKING MECHANISM HAVING EQUALIZER ARRANGEMENT

BACKGROUND OF THE INVENTION

1. Field of the Invention

This invention relates generally to extendible booms usable in gantries and other equipment for lifting heavy objects. More particularly, the invention relates to an extendible boom having a locking mechanism, which is configured to prevent unintended lowering of the boom and which includes a stabilizer arrangement, which coordinates operation of multiple components of the locking assembly.

2. Discussion of the Related Art

Extendible booms are well-known for a variety of heavy lift applications. Depending on the application and on the configuration of the booms, they can be used either individually or in gantries, which lift loads using two or more extendible booms operating in conjunction with one another. The typical boom of this type includes a stationary base and a lifting leg including at least first and second boom sections extending above the base. The first section is telescopically extendible relative to the second section using one or more hydraulic lift cylinders coupled to the first section. The second section may be stationary or may itself be telescopically extendible relative to a third section using the same multi-stage lift cylinder used to extend the first section or using a dedicated single-stage or multi-stage cylinder. In some booms, all extendible sections are "powered" because they are permanently coupled to at least one lift cylinder. The maximum stroke of such a boom is equal to the maximum stroke of the boom's cylinder(s). A boom of this type is disclosed, for example, in U.S. Pat. No. 4,381,839 to Engler et al. In other booms, at least one extendible section is a "manual" section because it can be fixed to an adjacent boom section after it is extended so as to permit the associated lift cylinder(s) to be retracted without retracting the manual section. This permits the cylinder(s) to subsequently be coupled to the adjacent section and then lift the two sections as a unit. In this manner, a load can be lifted to a height that exceeds the maximum stroke of the cylinder(s). A boom of this type is disclosed, for example, in U.S. Pat. No. 5,865,327 to Johnston (the Johnston '327 patent) and is marketed by J&R Engineering, Inc. under the Tradename "Lift-N-Lock."

The typical extendible boom relies on the integrity of the system's hydraulic pressure system to lift the load and to maintain the load in its lifted position. If the system experiences hydraulic pressure loss due, e.g., to a rupture of a hose, hydraulic pressure source failure, or hydraulic cylinder seal failure, the lift cylinder will retract in an uncontrolled manner, with resultant boom retraction and load lowering.

Some booms incorporate measures to prevent unintended boom lowering in the event of hydraulic pressure loss to the boom's lift cylinder(s). For instance, the Johnston '327 patent discloses a locking mechanism including two sets of toothed cams arranged on opposites sides of the boom. The cams are configured to engage and lock an extended section of the boom to prevent unintended lowering of that section relative to the adjacent section upon the loss of hydraulic fluid pressure to the lift cylinder(s) for the extendible section. Each set of cams is mounted on a pivot shaft so that its cams are pivotable, 1) from a disengaged position permitting lowering of the extendible section relative to the adjacent section, 2) to an engaged position in which the teeth on the cams engage the extendible section to prevent it from retracting. The cams are normally pivoted into their disengaged position by a release cylinder that is supplied with system pressure. They pivot towards their engaged position under the force of a spring when the system suffers a pressure loss and the release cylinder is allowed to retract.

The hydraulic locking mechanism described in the Johnston '327 patent operates very well in the event of a complete or near complete loss of hydraulic fluid pressure. However, a problem may arise if the system suffers only a partial pressure loss (on the order of less than 5% of the total system pressure). Such partial pressure losses can occur, for instance, when seepage occurs within the lift cylinders or when the volume of the pressurized fluid decreases as the fluid cools following a lift operation. In these situations, only enough fluid pressure is lost to result in sufficient release cylinder retraction to pivot the cams a few degrees. The cams of the two opposed sets seldom have exactly the same lost motion when pivoting from their disengaged position to their initial engaged position. Hence, when only a relatively small pressure loss occurs in the hydraulic system with a resultant relatively small cam stroke, it is entirely possible that only one set of cams will engage the extended boom section, while the other set of cams remains spaced from the extended section. In this situation, only one side of the extended section is locked, while the other side is still free to move unobstructed with respect to the adjacent section. A subsequent attempt to lower the boom under power of the lift cylinder will result in the imposition of uneven loads on the extended section that can lead to denting or even bending of the extended section. This potential problem can be avoided only by coordinating movement of the two sets of locking devices so that they are always either both engaged or both disengaged.

One way to achieve this effect might be to set overly large tolerances in the system such that neither set of cams would engage the extended boom section unless both sets pivot through a lost motion stroke indicative of complete or catastrophic pressure loss in the system. However, a system configured in this manner necessarily would exhibit a substantial delay between the time of the pressure loss and the time of cam engagement. This delay would prevent the locking mechanism from engaging the extended boom section before it begins to retract. This situation is undesirable because the ideal locking mechanism responds nearly instantaneously to system pressure loss so as to lock the extended section of the boom from retraction without any boom lowering and without imposing shock loads on the boom.

OBJECTS AND SUMMARY OF THE INVENTION

It is therefore a first principal object of the invention to provide an extendible boom incorporating a locking mechanism that avoids binding or bending loads on the locked boom section by assuring that locking forces are always applied at least essentially equally to both sides of the locked section.

A second object of the invention is to provide an extendible boom that meets the first principal object and that is relatively simple in construction, easy to fabricate, and easy to assemble.

Another object of the invention is to provide an extendible boom that meets the first principal object and that need not accommodate excessive lost motion in its locking mechanism.

In accordance with a first aspect of the invention, these objects are achieved by providing an extendible boom comprising a base, first and second extendible boom sections which are supported on said base, a hydraulic lift cylinder which has a lower end and which has an upper end operatively coupled to said first section so as to raise said first section relative to said second section upon lift cylinder extension, and a locking mechanism. The locking mechanism includes first and second locking devices which are mounted on opposite sides of the boom and each of which is movable, relative to the boom, a) from a disengaged position permitting lowering of the first section, b) to an engaged position in which the locking devices engage the first section to prevent the first section from being lowered. The locking mechanism additionally includes an equalizer arrangement which is connected to both of the first and second locking devices and which mechanically couples the locking devices to one another so that both of the locking devices always move through at least essentially the same stroke at least essentially the same time.

Preferably, each of the locking devices comprises at least one cam and a pivot shaft on which the cam is mounted for rotation therewith. In this case, the equalizer arrangement preferably comprises an equalizer bar having a first end operatively connected to the pivot shaft of the first locking device and a second end operatively connected to the pivot shaft of the second locking device.

A second principal object of the invention is to provide a method of lifting a load that is responsive to decreased hydraulic pressure in a hydraulic lift cylinder of an extendible boom to mechanically engage the extended boom section(s) without imparting any bending or twisting forces on the extended section.

Another object of the invention is to provide a method that meets the second principal object and that maintains near-immediate responsiveness to hydraulic pressure loss.

In accordance with another aspect of the invention, these objects are achieved by providing a boom having first and second sections, supporting the load on the first section, extending the first section relative to the second section using a hydraulic lift cylinder, and, in response to decreased hydraulic pressure to the lift cylinder, automatically mechanically engaging the first section to prevent unintended lowering of the load. The automatically engaging step comprises moving first and second locking devices on opposite sides of the first section into engagement with the first section while correlating movement of the first and second locking devices so that both of the locking devices always move through at least essentially the same stroke at least essentially the same time.

Preferably, the step of mechanically engaging comprises rotating a cam of each of the locking devices into engagement with the first section, the cams normally being retained in a disengaged position by hydraulic pressure and rotating into an engaged position upon loss of hydraulic pressure to the lift cylinder. Each of the cams may be mounted on a respective rotatable pivot shaft, in which case the pivot shafts are mechanically coupled together so that rotation of one pivot shaft drives the other pivot shaft to simultaneously rotate through a stroke that at least essentially equals a pivot stroke of the one pivot shaft.

These and other objects, features, and advantages of the present invention will become apparent to those skilled in the art from the following detailed description and the accompanying drawings. It should be understood, however, that the detailed description the specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DESCRIPTION OF PREFERRED EMBODIMENTS

1. Resume

Pursuant to the invention, an extendible boom is provided that incorporates a locking mechanism that mechanically engages an extended boom section in response to the loss of hydraulic fluid pressure to the lift cylinder(s) for that boom section so as to prevent unintended boom lowering. The locking mechanism includes locking devices, such as toothed cams, that are located on opposite sides of the boom and that are configured to move, 1) from a disengaged position permitting unobstructed movement of the extended section relative to the adjacent section, 2) to an engaged position in which the locking devices engage opposite sides of the extended section to prevent unintended boom lowering. In order to prevent the imposition of unequal locking forces that could occur if only the locking device on one side of the extended boom section were to engage that section, an equalizer arrangement mechanically couples the locking devices on opposite sides of the extended boom section to one another so that both locking devices always move through essentially the same stroke at essentially the same time. The equalizer arrangement preferably comprises an equalizer bar that mechanically couples pivot shafts of the two locking devices together so that rotation of one pivot shaft drives the other pivot shaft to simultaneously rotate through a pivot stroke that at least substantially equals a pivot stroke of the one shaft.

2. System Overview

Figure 1:
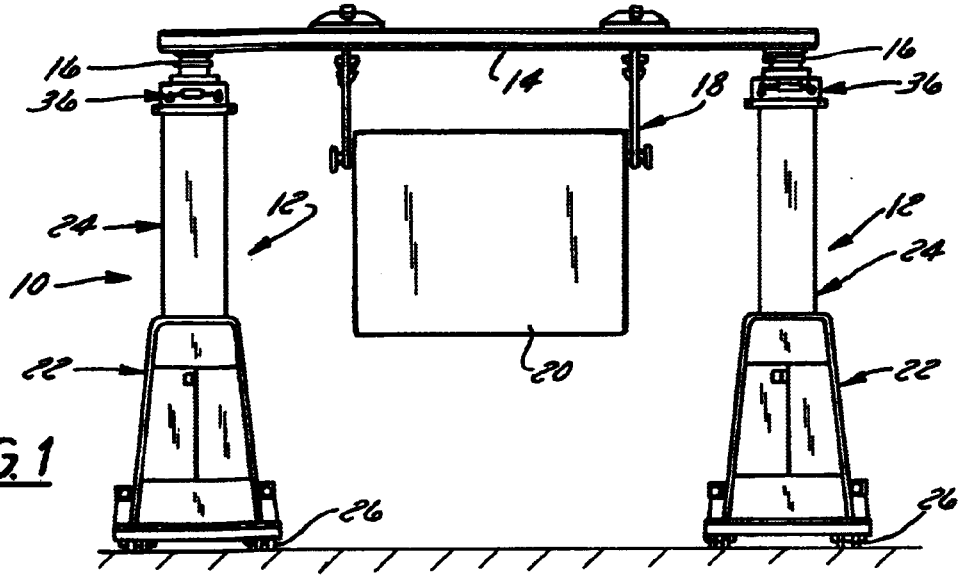
FIG. 1 illustrates a gantry including a pair of extendible hydraulic booms each having a locking mechanism constructed in accordance with a preferred embodiment of the invention.
Figure 2:
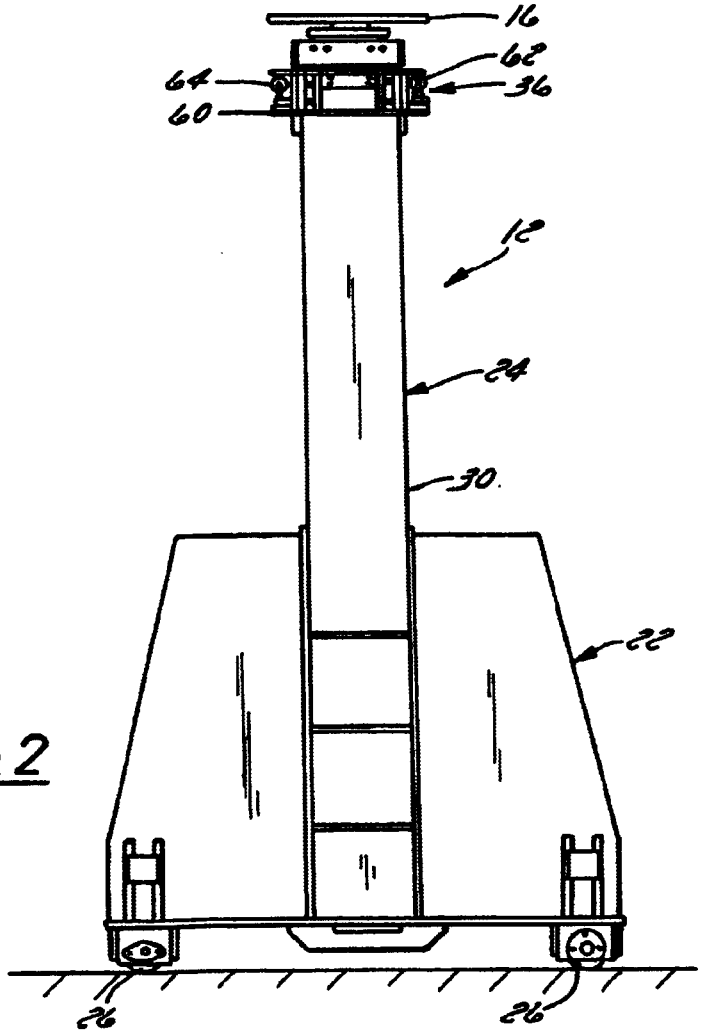
FIG. 2 is a side elevation view of one of the extendible booms of FIG. 1.

Referring initially to FIG. 1, a gantry 10 is illustrated that includes two extendible booms 12 that are constructed in accordance with the invention. The booms 12 are coupled to one another by a lift beam 14 that is mounted on top of swiveling header plates 16 on the booms 12 so as to be raised and lowered upon extension and retraction of the booms 12. A rigging device 18 is provided on the lift beam 14 for connection to a load 20 to be lifted. The rigging device 18 may include chains, cables or any other structure that selectively connects the load 20 to the lift beam 14 or may include a powered rigging device.

Referring to FIGS. 2–6, each boom 12 includes a base 22 and a lifting leg 24. The base 22 may be stationary or may, as illustrated, include wheels 26 for movement along the ground or rails. Each lifting leg 24 is formed from a plurality of generally concentric nested boom sections 28, 30, and 32 and at least one hydraulic lift cylinder 34. The illustrated exemplary lifting leg 24 includes one single-stage lift cylinder 34 (FIG. 5), first and second powered sections 28 and 30, and a manual section 32. The second powered section 30 is stationary. The first powered section 28 is telescopically received within the second powered section 30 so as to be extendible and retractable relative to the second powered section 30. The manual section 32 is telescopically received with the first powered section 28 so as to be extendible and retractable relative to the first powered section 28. The first powered section 28 is lockable in position using a locking mechanism 36 detailed below.

Figure 5:
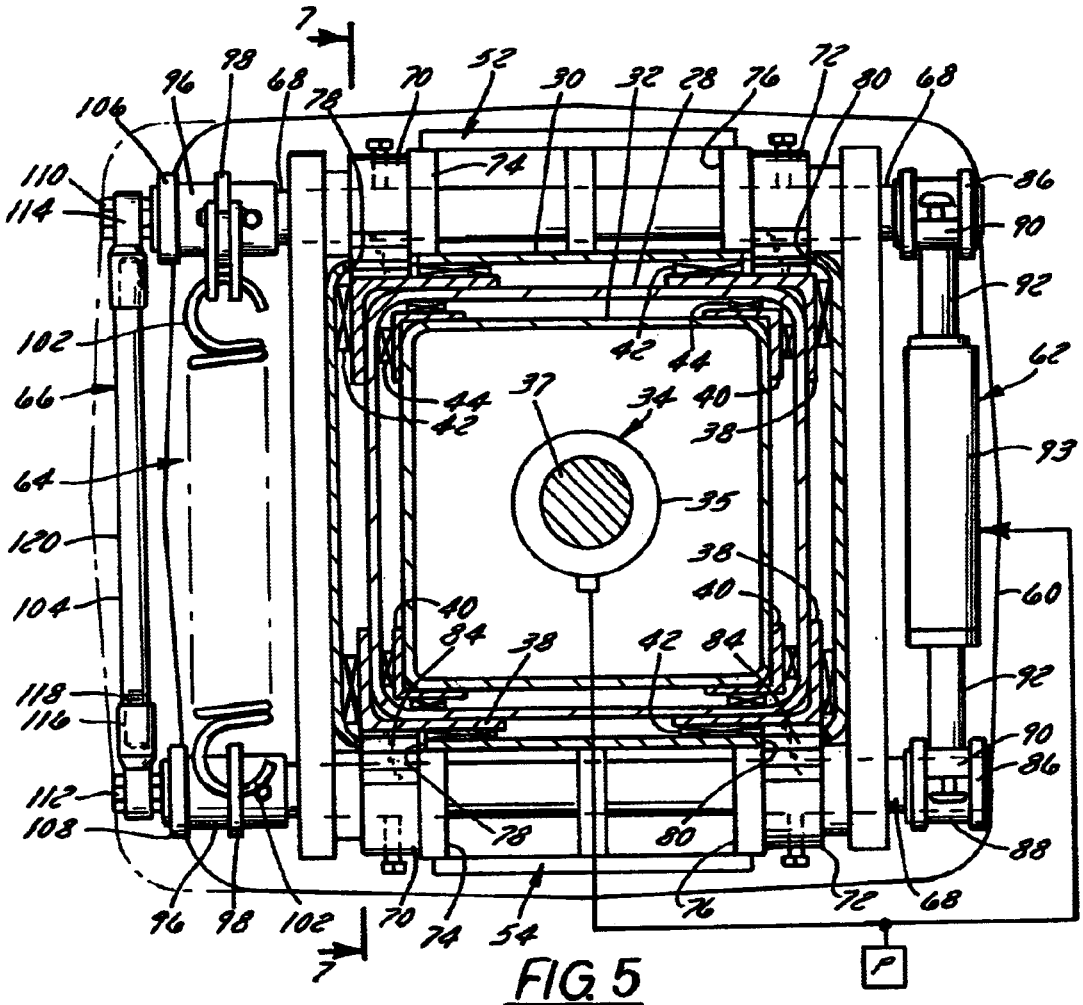
FIG. 5 is a sectional plan view taken generally along the lines 5—5 in FIG. 4.
Figure 6:
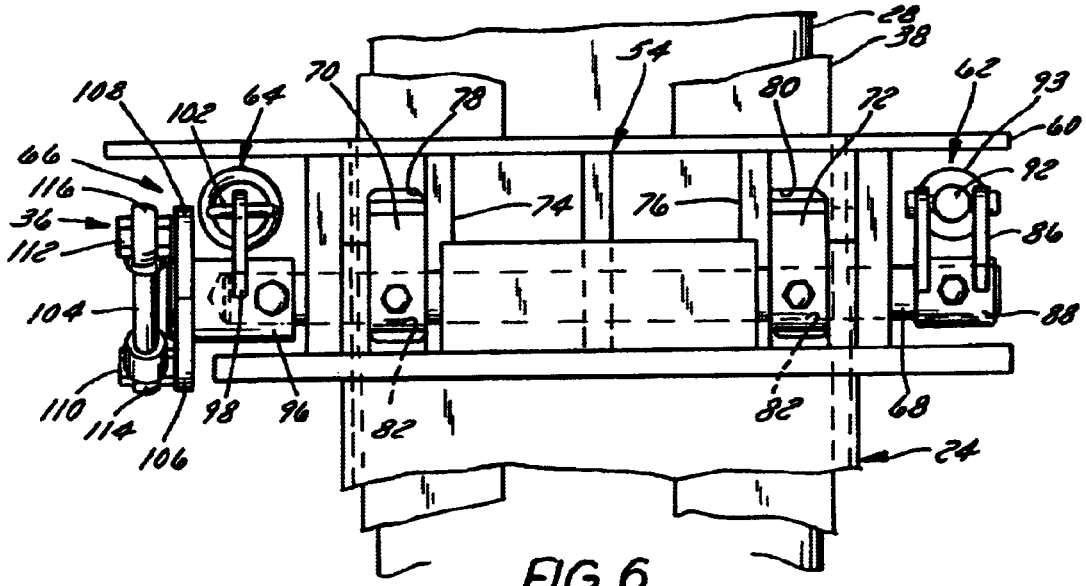
FIG. 6 is a left-side elevation view of the upper end of the boom of FIG. 2.

Each of the boom sections 28, 30, and 32 is made from square structural tubing. Referring to FIG. 5, the comers of each of the first powered section 28 are reinforced with angle irons 38. Sliding movement between the first and second powered sections 28 and 30 is facilitated by slide pads 42 which are affixed to the inner wall of the second powered section 30 and which slide against the angle irons 38 on the first powered section 28. Slide pads 44 are also provided between the first powered section 28 and the manual section 32 and slide against the angle irons 40 on the manual section 32.

The hydraulic lift cylinder 34 is disposed within the interior of the lifting leg 24 in an inverse orientation, i.e., with its barrel end 35 disposed beneath its rod end 37. The inverse orientation of the lift cylinder 34 places the input and output ports of the lift cylinder 34 at a stationary position at the bottom of the lifting leg 24. Thus, complex hydraulic hose reels are not required to provide additional hydraulic hose length when the lift cylinder 34 extends and to take up excess hose length as the lift cylinder retracts.

Figure 3:
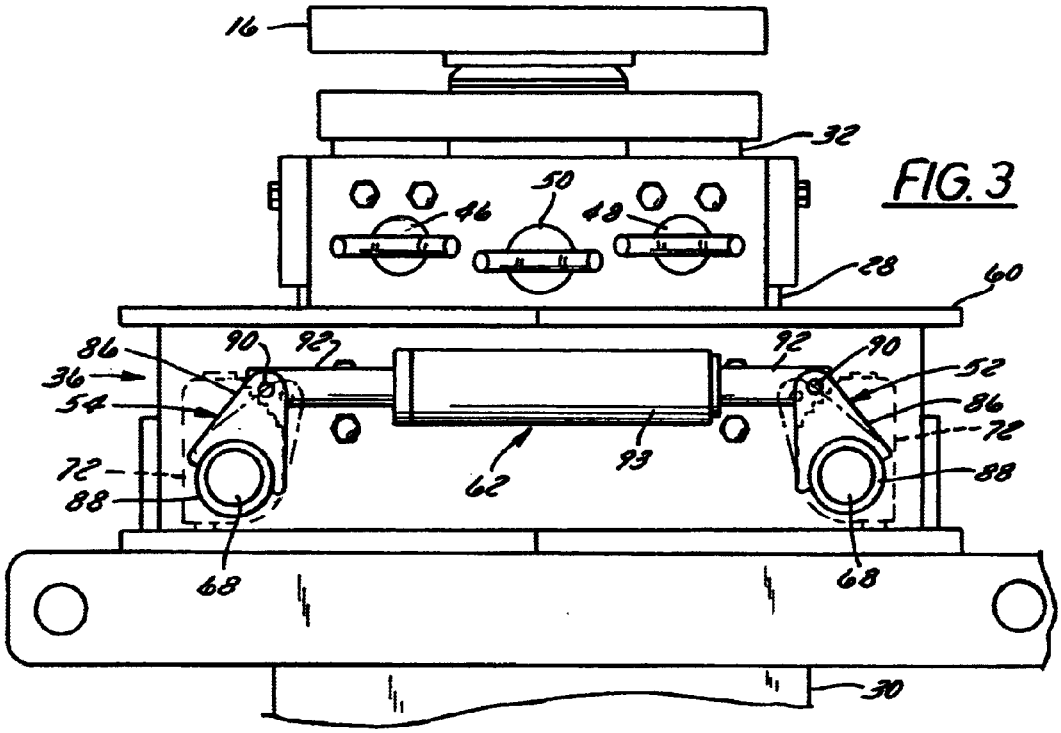
FIG. 3 is a front elevation view of the upper end-most portion of the boom of FIG. 2.
Figure 4:
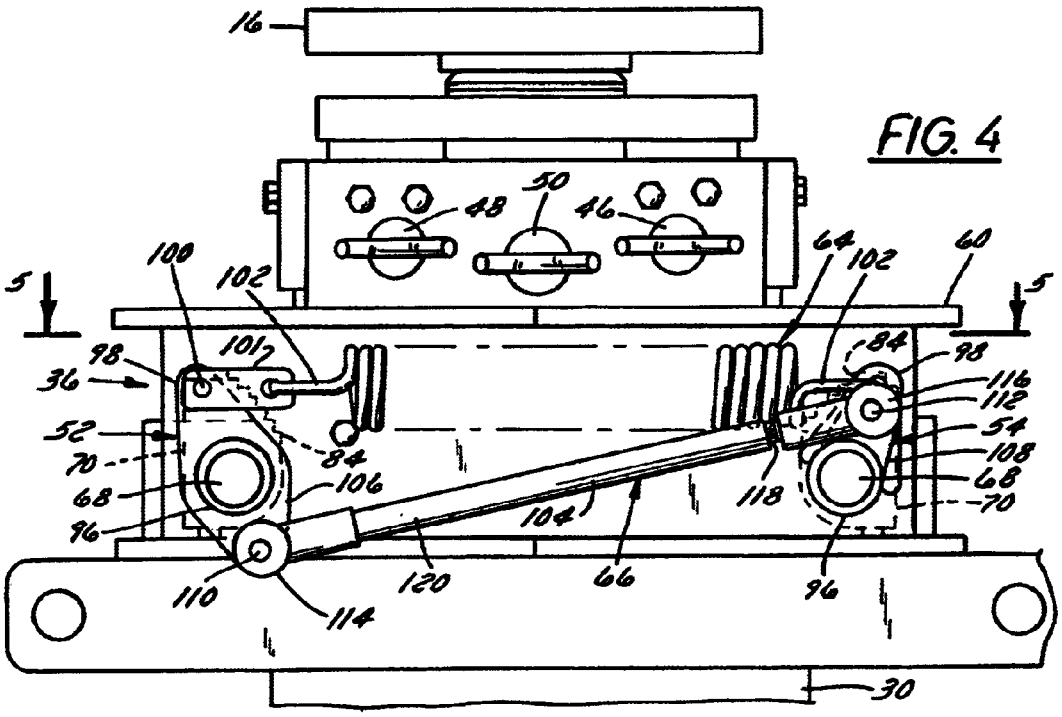
FIG. 4 is a rear elevation view of the upper end portion of the boom of FIG. 2.

In order to permit the load to be lifted to a height exceeding the maximum stroke of the lift cylinder 34, the bottom end of the manual section 32 is selectively affixable to the top end of the first powered section 28 using a suitable coupler. In the illustrated embodiment, the coupler takes the form of a pin arrangement including two boom pins 46 and 48 and one cylinder pin 50. The two boom pins 46 and 48 are located on either side of the cylinder pin 50 as shown in FIGS. 3 and 4. All three pins 46, 48, and 50 extend through mating pinning holes in the first powered section 28 and the manual section 32, and the cylinder pin 50 additionally selectively extends through the barrel of the lift cylinder 34. While the pins 46, 48, and 50 preferably extend all of the way through the boom 12, two sets of cantilevered pins may be inserted through the boom 12 from opposite sides. At least the boom pins 46 and 48 could also be replaced by a lock collar arrangement or any other arrangement that selectively prevents the manual section 32 from retracting relative to the first powered section 28.

Extending the telescoping sections 28 and 32 to a height exceeding the maximum stroke of the lift cylinder 34 includes the following steps. First, the manual section 32 is extended coordinately with the lift cylinder 34. When the lift cylinder 34 is fully extended, the pinning holes in the upper end of the first powered section 28 become aligned with the pinning holes in the lower end of the manual section 32. The boom pins 46 and 48 are then fully inserted in the associated pinning holes. This locks the manual section 32 to the adjacent first powered section 28. The lift cylinder 34 may then be retracted within the manual section 28 until a pinning hole, formed in the barrel end of the lift cylinder 34, is aligned with the center pinning hole in the first powered section 28. The cylinder pin 50 can then be inserted through the mating pinning holes and the lift cylinder 34 to lock the lift cylinder 34 to the bottom of the manual section 32 and to the top of the first powered section 28. Subsequent extension of the lift cylinder 34 will coordinately raise the first powered section 28 and the manual section 32.

Retraction of the sections is performed as follows. The first powered section 28 is retracted with the lift cylinder 34 until the cylinder pin 50 is freed from binding pressure and the first powered section 28 is fully retracted. The cylinder pin 50 is then removed, and the lift cylinder 34 is extended into contact with the upper end of the manual section 32 and then extend further until the boom pins 46 and 48 become free from binding pressure. The boom pins 46 and 48 are then removed, and the lift cylinder is retracted to lower the manual section 32.

3. Locking Mechanism

The purpose of the locking mechanism 36 is to prevent unintended boom lowering which would otherwise occur when the lift cylinder 34 is extended and there is a loss of hydraulic pressure in the system due, for example, to the rupture of a hose. In the illustrated embodiment in 5 which each boom 12 has a single extendible powered section 28, a single locking mechanism 36 is provided for each boom 12 and is located near the top of the stationary second powered section 30 for engagement with the first powered section 28. The locking mechanism 36 may comprise any of a variety of structures incorporating a pair of locking devices 52 and 54 disposed on opposite sides of the boom 12 and operable to simultaneously engage both sides of the extended boom section 28 in the event of hydraulic pressure loss to the boom's lift cylinder 34. In the illustrated embodiment, the locking devices 52 and 54 are mounted on a support collar 60 disposed near the upper end of the second powered section 30 and are coupled to one another by a release cylinder 62, a spring 64, and an equalizer arrangement 66 as best seen in FIGS. 2–6. The release cylinder 62 is mounted on the front of the boom 12, and the spring 64 and equalizer arrangement 66 are mounted on the rear of the boom 12. All of these structures are supported on the support collar 60.

Each locking device 52 and 54 includes a pivot shaft 68 and a set of cams 70, 72. Each pivot shaft 68 extends laterally of the boom 12 adjacent the outer wall of the second powered section 30 and is mounted on the,collar 60 by a pair of bearings 74 and 76 that hold the pivot shaft 68 in place while permitting it to rotate about a central axis. The cams 70 and 72 of each locking 20 device 52 or 54 are mounted on the associated pivot shaft 68 in a spaced-apart arrangement so as to be aligned with corresponding openings 78 and 80 in the outer wall of the second powered section 30. Each cam 70, 72 includes, 1) a through-hole 82 via which the cam is affixed to the associated pivot shaft 68, and 2) an inclined, toothed surface 84 that faces the associated opening 78 or 80. The toothed surface 84 is configured so that it is spaced from the first powered section 28 when the locking mechanism 36 is in its disengaged position seen in FIG. 7 and is rotated into locking engagement with the angle irons 38 on the first powered section 28 when it pivots into its engaged position seen in FIG. 8. Hence, both cams 70 and 72 of each locking device 52 and 54 rotate simultaneously into or out of engagement with the associated side of the first powered section 28.

The release cylinder 62 comprises a two way, dual piston hydraulic cylinder pivotably connected to both pivot shafts 68 so that both pivot shafts rotate upon extension or retraction of the release cylinder 62. Specifically, two ear mounts 86 are provided, each of which is affixed to a sleeve 88 mounted on the front end of the associated pivot shaft 68. Each ear mount 86 has a pivot connection. 90 located above and inwardly from the axial centerline of the associated pivot shaft 68. A respective rod 92 of the release cylinder 62 is connected to each pivot connection 90 so that release cylinder extension and retraction pivots the ear mounts 86 to rotate the pivot shafts 68 in opposite directions. A barrel 93 of the release cylinder 62 is connected to the same pressure source P that supplies pressurized hydraulic fluid to the lift cylinder 34 so that the rods 92 are normally held in their extended position by system pressure. This connection is illustrated in FIG. 5.

The spring 64 extends laterally of the rear of the boom 12 and is operably coupled to the pivot shafts 68 of both locking devices 52 and 54 so as to bias the locking devices 52 and 54 toward their engaged position. Specifically, a sleeve 96 is affixed to the rear end of each of the pivot shafts 68, and an ear mount 98 extends upwardly and rearwardly away from each sleeve 96 to present a connection point 100 for an associated end 102 of the spring 64 (one end 102 of the spring 64 being connected to the associated pivot point 100 via a pivot link 101 to accommodate pivoting of the ear mount 98). As a result of this arrangement, spring 64 biases the ear mounts 98 towards one another against the force of the release cylinder 62 so that, upon loss of hydraulic fluid in the system, the spring 64 pivots the ear mounts 98 towards one another to rotate the pivot shafts 68 and to engage the locking devices 52 and 54.

The equalizer arrangement 66 is configured to mechanically tie the pivot shafts 68 of the two locking devices 52 and 54 together so that they rotate at least essentially at the same time and through at least essentially the same stroke. The equalizer arrangement 66 includes an equalizer bar 104 and a pair of ear mounts 106 and 108, one of which is associated with each locking mechanism 52 and 54. The ear mounts 106 and 108 are affixed to the sleeves 96 bearing the ear mounts 98 for the spring 64. Both ear mounts 106 and 108 extend in parallel with the associated ear mounts 98 for the spring 64 but in opposite directions so that a connection point 110 of one ear mount 106 is located below the level of the pivot shafts 68 and a connection point 112 for the other ear mount 108 is located above the level of the pivot shafts 68. The equalizer bar 104 is a straight metal member having first and second ends 114 and 116 that are pivotably connected to the respective connection points 110 and 112 on the ear mounts 106 and 108 so that the ear mounts 106 and 108 and equalizer bar 104 move together as a unit. Limited pivotable movement between the ear mounts 106 and 108 and the equalizer bar 104 is accommodated by ball and socket joints on the ends 114 and 116 of the equalizer bar 104. In order to permit the same equalizer bar to be used with extendible booms of different dimensions and to accommodate manufacturing tolerances, the equalizer bar 104 is preferably made to be adjustable in length, e.g., by forming it from a first, female section 118 and a second, male section 120 threaded into a hollow free end of the female section 118 to form a tumbuckle-type arrangement.

Figure 7:
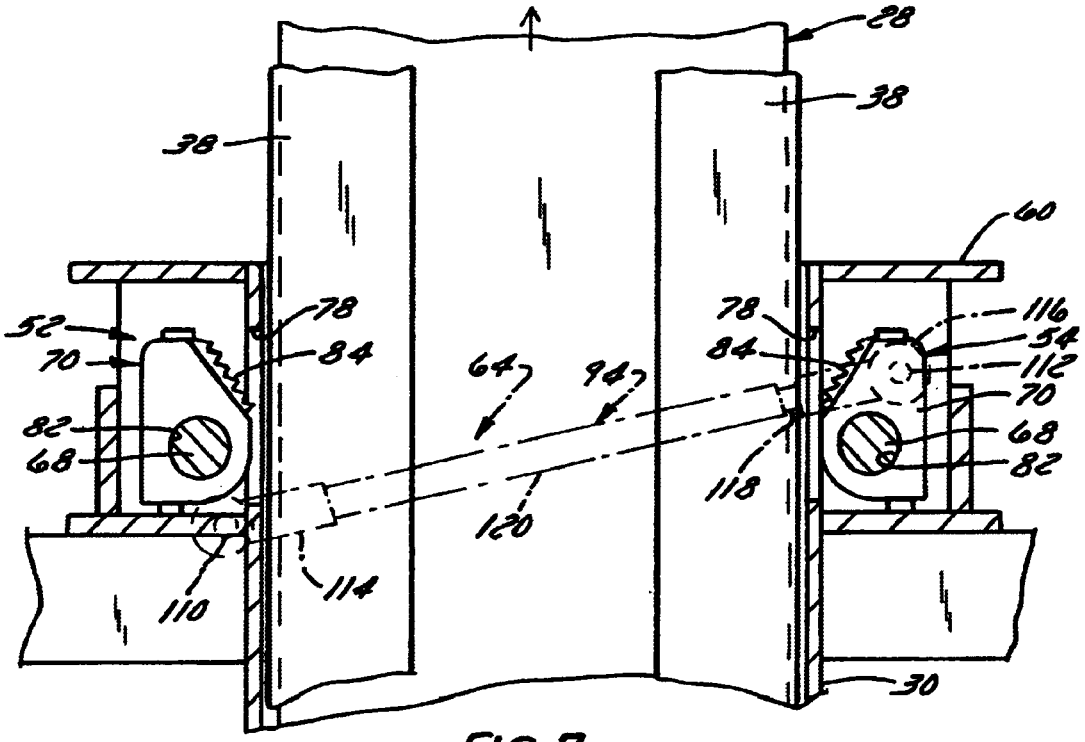
FIG. 7 is a sectional elevation view taken generally along the lines 7—7 in FIG. 5 and illustrating the cams of a locking mechanism of the boom in a disengaged position.
Figure 8:
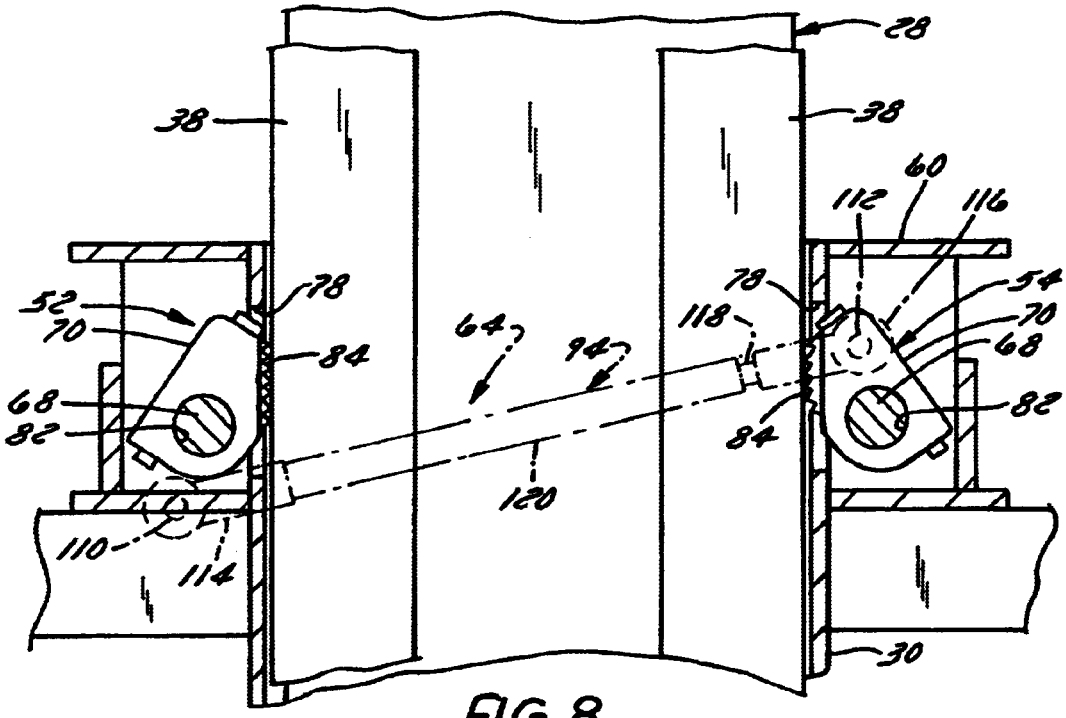
FIG. 8 corresponds to FIG. 7 and illustrates the cams of the locking mechanism in an engaged position.

During normal operation of the locking mechanism 36, hydraulic fluid pressure in the release cylinder 62 forces both locking devices 52 and 54 to the position illustrated in FIG. 7 against the biasing force of the spring 64. However, should the system encounter catastrophic hydraulic pressure loss when the first powered section 28 is extended, the cams 70 and 72 of both lock devices 52 and 54 will pivot through the openings 78 and 80 in the second powered section 30 and into engagement with the angle irons 38 on the first powered 28 as illustrated in FIG. 8 to prevent unintended lowering of the section 28. Cam engagement occurs before appreciable boom 5 lowering due to the fact that there is only a very small lost motion between the disengaged and engaged positions of the cams 70 and 72. Upon restoration of fluid pressure, the cams 70 and 72 will simply rotate back to the disengaged position of FIG. 7, thereby permitting the boom to be raised and lowered in its intended fashion.

If the boom's hydraulic system does not encounter catastrophic pressure loss but instead encounters only a small amount of pressure loss due, e.g., to fluid seepage or cooling of the pressurized fluid, the release cylinder 62 may retract slightly, leading to sufficient cam rotation to result in initial engagement of one locking device 52 and 54 with the inner powered section 28. In this eventuality, any rotation of the pivot shaft 68 associated with one locking device 52 or 54 that would otherwise occur in addition to rotation of the pivot shaft 68 of the other locking device 54 or 52 is translated to the pivot shaft 68 of the other locking device 54 or 52 through the equalizer arrangement 66. As a result, both locking devices 52 and 54 move through at least essentially the same stroke at least essentially at the same time and, therefore, initially engage the first powered section 28 of the boom 12 at essentially the same time. This prevents binding and potential damage to the boom 12 that could otherwise occur if a locking device 52 or 54 on only one side of the boom 12 were to pivot to its engaged position.

Many changes and modifications may be made to the invention without departing from the spirit thereof. For instance, the locking devices 52 and 54 need not include the illustrated cams but instead could comprise any mechanical structures that selectively move into and out of locking engagement with the extended boom section and that can be tied together by an equalizer arrangement so as to assuredly move simultaneously even upon only a partial pressure loss in the system. The scope of other changes will become apparent from the appended claims.

We claim:

1. An extendible boom comprising:

(A) a base;

(B) first and second extendible boom sections which are supported on said base;

(C) a hydraulic lift cylinder which has a lower end and which has arm upper end operatively coupled to said first section so as to raise said first section relative to said second section upon lift cylinder extension; and (D) a locking mechanism including (1) first and second locking devices which are mounted on respective first and second pivot shafts located on opposite sides of said boom and each of which is pivotable, relative to said boom a) from a disengaged position permitting lowering of said first section, b) to an engaged position in which said locking devices engage said first section to prevent said first section from being lowered, (2) a hydraulic release cylinder having opposite ends connected to said first and second pivot shafts and movable between a) an extended position when said locking devices are in said disengaged position and b) a retracted position when said locking devices are in said engaged position, and (3) a rigid equalizer bar which is connected to both of said first and second pivot shafts and which mechanically couples said pivot shafts to one another so that both of said pivot shafts always pivot through at least essentially the same stroke at least at essentially at the same time.

2. An extendible boom as claimed in claim 1, wherein said release cylinder is pressurized by a hydraulic pressure which decreases with a decrease in hydraulic pressure to said lift cylinder.

3. An extendible boom as defined in claim 2, wherein each of said locking devices is spring-biased towards said engaged position.

4. An extendible boom as defined in claim 1, wherein each of said locung devices comprises at least one cam.

5. An extendible boom as defined in claim 4, wherein said equalizer arrangement further comprises 1) a first mount which is fixedly mounted on said first pivot shaft and to which a first end of said equalizer bar is pivotally connected, and 2) a second mount which is fixedly mounted on said second pivot shaft and to which a second end of said equalizer bar is pivotally connected.

6. An extendible boom as defined in claim 4, wherein said cam of each of said locking devices is located adjacent a first end of the associated pivot shaft, and wherein each of said locking devices further comprises another cam affixed to the associated pivot shaft adjacent a second end thereof.

7. An extendible boom as defined in claim 1, further comprising a third section which is located at least substantially concentrically within said first section and which is extendible relative to said first and second sections.

8. An extendible boom comprising:

(A) a base;

(B) first and second at least substantially concentric sections which are supported on said base;

(C) a hydraulic lift cylinder which has a lower end and which has an upper end operatively coupled to said first section so as to raise said first section relative to said second section upon lift cylinder extension; and (D) a locking mechanism including (1) a generally rectangular support which has a pair of spaced lateral sides and a pair of spaced longitudinal sides;

(2) first and second locking devices which are mounted on respective lateral sides of said support and each of which is movable, relative to said support, a) from a disengaged position permitting lowering of said first section b) to an engaged position in which said locking device engages said first section to prevent said first section from being lowered, each of said locking devices including a) a pivot shaft which extends longitudinally of said support and which is pivotally mounted on said support, b) a pair of longitudinally spaced cams, each of which is mounted on said pivot shaft for rotation therewith so that said cams engage said first section when the associated locking device is in said engaged position and is disengaged from said first section when the associated locking device is in said disengaged position, (3) a release cylinder which extends laterally of said support and which is operatively coupled to both of said pivot shafts, said release cylinder biasing said locking devices to said disengaged position using a hydraulic pressure which decreases with a decrease in hydraulic pressure to said lift cylinder;

(4) a spring which extends laterally of said support and which is operatively coupled to both of said pivot shafts to bias said locking devices toward said engaged position; and (5) an equalizer arrangement which is operatively connected to both of said pivot shafts and which mechanically couples both of said pivot shafts to one another so that both of said locking devices always move through at least essentially the same stroke at least essentially the same time, said equalizer arrangement comprising an equalizer barwhich has a first end which is operatively coupled to the pivot shaft of said first locking device and a second end which is operatively coupled to the pivot shaft of said second locking device.

9. An extendible boom as defined in claim 8, wherein said equalizer arrangement further comprises 1) a first ear mount which is fixedly mounted on the pivot shaft of said first locking device and to which a first end of said equalizer bar is pivotally connected, and 2) a second ear mount which is fixedly mounted on the pivot shaft of said second locking device and to which a second end of said equalizer bar is pivotally connected.

* * * * *